US005265742A

United States Patent [19]

Stenger et al.

[11] Patent Number: 5,265,742

[45] Date of Patent: Nov. 30, 1993

[54] PORTABLE, COLLAPSIBLE HOIST APPARATUS

[76] Inventors: Donald D. Stenger, 5840 Castleton Dr., San Diego, Calif. 92117; Fred E. Stenger, 1141 Blackbird St., El Cajon, Calif. 92020

[21] Appl. No.: 44,746

[22] Filed: Apr. 12, 1993

[51] Int. Cl.[5] ..... B66C 23/18

[52] U.S. Cl. ..... 212/179; 182/60; 187/2; 414/10; 212/263

[58] Field of Search ..... 212/179, 175, 263; 414/10, 11; 187/2; 182/60

[56] References Cited

U.S. PATENT DOCUMENTS

| | | | |
|---|---|---|---|
| 917,686 | 4/1909 | Wagner | 212/175 |
| 980,330 | 1/1911 | Olander | 212/179 |
| 1,456,362 | 5/1923 | Cresson | 182/60 |
| 1,665,991 | 4/1928 | Stramaglia | 182/60 |
| 1,770,555 | 7/1930 | Shepley | 187/2 |

*Primary Examiner*—Michael S. Huppert
*Assistant Examiner*—Thomas J. Brahan
*Attorney, Agent, or Firm*—Frank D. Gilliam

[57] ABSTRACT

A hoist apparatus for lifting objects up the side of a building or the like and swinging the objects onto the roof or other surface. The hoist can be erected and operated by one person and can be folded into a compact, easily moved, package. A pair of spaced triangular leg assemblies are typically clamped to the edged of the roof parapet in a spaced relationship. Each triangular assembly when installed for this use is made up of a first leg formed by one beam that is a vertical portion of the clamp and a flexible extension, such as a chain, extending from the lower end of the beam, a second leg secured at one end to the free end of the extension and a third leg pivotally connected between the second ends of the first and second legs, forming a triangle with an acute angle between the second and third legs. A cross beam extends between the second and third leg connections and is adapted to carry a hoist, typically a block and tackle arrangement. In use, the hoist is attached to an object on the ground and lifts the object up the side of the structure to just above the roof edge. The beam is pulled toward the roof edge and the triangle moves over center and reverses so that the beam is over the roof, so that the hoist can lower the object onto the roof. At least some of the legs are telescoping and the beam-to-leg connections are foldable. The clamp assembly is foldable into a compact package, so that a single person can erect and install the hoist apparatus, lift objects onto or off of the structure, then dismount and carry the components down a ladder, stairwell or the like.

10 Claims, 1 Drawing Sheet

PORTABLE, COLLAPSIBLE HOIST APPARATUS

BACKGROUND OF THE INVENTION

This invention relates in general to hoisting apparatus and, more specifically to a foldable hoist apparatus that can be erected, operated and dismounted by one person and is capable of lifting an object up the side of a structure and swinging the object onto the structure roof.

Over the years, a large variety of devices for lifting objects to the roof or other levels of buildings have been developed. Typically, these devices may be used to lift construction materials during construction of the building, to hoist repair materials or other additions to the roof of an existing building or to deliver large objects, such as pianos, air conditioners, factory machine tools or the like to upper floors or roofs of buildings. The lifting devices typically have included cranes, either mobile or assembled on-site, temporary or permanent elevators, hoists assembled at the site, etc.

Typical early cranes include the portable, mobile, crane described by Hescock in U.S. Pat. No. 1,428,887. Such cranes and other modern roadable cranes are very effective where the height an object is to be lifted is not excessive and there is room to maneuver the crane into place. However, mobile cranes are height limited, expensive and often require several persons to assemble and operate.

Elevator-like hoists, of the sort described in the early U.S. Pat. No. 22.008 to Barr, are effective for lifting objects up a vertical shaft in a building, typically carrying people or freight. However, these lifts are not suitable for lifting repair materials or the like at different locations on an occasional basis. Similarly, "A-frame" type lifting devices of the sort described by Scherer in early U.S. Pat. No. 1,143,786 and Weston in very early U.S. Pat. No. 1,216,298 can lift objects vertically through a hatch or the like from a position between spread support legs. However, the height these devices can lift is severely limited and they cannot lift objects up the side of a structure.

Boat davits have long been used for lifting small boats to the deck of a ship, up to a pier, etc. Typical of these is the arrangement described by Franklin et al. in U.S. Pat. No. 5,020,463. The davits are fixedly mounted onto the ship or pier, with winch motors for lifting boats through cables. Such davits, however, are not portable, are very large and heavy, and generally cannot be operated by a single person.

At the present time there is a particular need for simple, light weight, hoisting devices useable by a single person, for lifting tools for repairing roof mounted air conditioning units onto and off of roofs. Most such air conditioners presently use chlorofluorocarbons (CFCs) as the refrigerant. In order to prevent the release of the possibly ozone-depleting CFCs into the atmosphere. Recovery units have been developed that withdraw the refrigerant, purify it and return it to the air conditioner. Federal statutes prohibit the release of CFCs during repair of those air conditioners. In the future, similar units may be used to withdraw the CFC and replace it with another refrigerant. These units may weigh 100 pounds or more and are of a size that makes them difficult to carry up ladders to the roof. Therefore, there is a significant need for devices for hoisting the CFC recovery unit, tools, other parts, etc. to a roof which can be brought to the roof and assembled by a single technician to permit easy and convenient repair of roof mounted air conditioners.

Thus, it is apparent that although various lifting devices and systems have been in use for a very long time, there is a continuing need for improved hoisting devices that are lightweight, portable, can be erected, installed and operated by a single person and are capable of lifting objects up the side of a structure and swinging them onto the structure roof under the control of the single person, and then can be easily dismounted and removed after use.

SUMMARY OF THE INVENTION

The above-noted long-felt needs are met, basically, by a hoisting device which basically comprises a pair of spaced triangular leg assemblies secured to, and part of, a clamping assembly capable of being secured to a building roof parapet or the like, with a cross beam between the leg assemblies for supporting a lifting mechanism, such as a block-and-tackle. The assembly is easily erected and mounted by one person, who then can lift an object to the roof and swing the leg assembly over center to deposit the object onto the roof. Once all hoisting operations are complete, the hoist is dismounted, compacted and folded into a package that is easily carried away by one person.

Each triangular leg assembly is made up of three legs. A first leg (that is substantially vertical when the hoist is in use), comprises a beam portion connected at one end to a flexible extension (typically a chain or flexible cable). The second leg of the triangle has a first end secured to the end of the flexible portion. The third leg is pivotally connected to the second ends of said first and second legs. The legs are sized such that the first and second legs form an acute angle.

Clamp means incorporating said beam portions of said first legs are adapted to releasably secure the triangular assemblies in a spaced relationship along the roof edge, such as by clamping around a roof edge parapet. The cross beam extends between the spaced triangular assemblies, being secured between the intersections of the second and third legs of each triangular assembly. The lifting mechanism is secured to the cross beam intermediate to its ends.

In operation, the operator carries the hoisting mechanism to the roof where it is erected to a hoisting configuration and mounted in a hoisting position. The object to be hoisted is moved from ground level to a position somewhat above the roof and parapet level. The cross beam is then pulled toward the roof edge, such as by a short rope secured to the cross beam. Because of the flexible extension portion of the first leg, the triangular assembly can move over center, creating slack in the flexible extension, so that the cross beam moves over and past the roof edge, swinging the object to a position where it can be lowered to the roof surface. This sequence can be reversed to lower an object from the roof to the ground. The hoisting device can then be dismounted and folded and carried away, typically down a ladder, stairway, building elevator, etc.

The second leg is preferably made up of telescoping tubes, that can be telescoped together for carrying to and from the site and extended and locked into extended position by pins, bolts or the like. The hoisting device of this invention is further versatile in that by shortening the second leg, then arranging the triangle as a generally equilateral triangle, with the first leg substantially horizontal, the triangular assemblies may be placed on opposite sides of a hatch, with the cross beam over the hatch, so that objects can be lifted up or down through the hatch.

Preferably, the clamp is made up of folding channel sections and a clamping screw, so that the clamp can be unfolded into a "C-clamp" like configuration for clamping around a parapet or the like, then folded into a compact configuration for transportation. Similarly, the cross beam preferably includes folding attachments to the triangular assemblies, as detailed below, to permit folding of the triangular assemblies and cross beam into a compact package for transportation.

BRIEF DESCRIPTION OF THE DRAWING

Details of the invention, and of certain preferred embodiments thereof, will be further understood upon reference to the drawing, wherein.

DETAILED DESCRIPTION OF PREFERRED EMBODIMENTS

Figure 2:
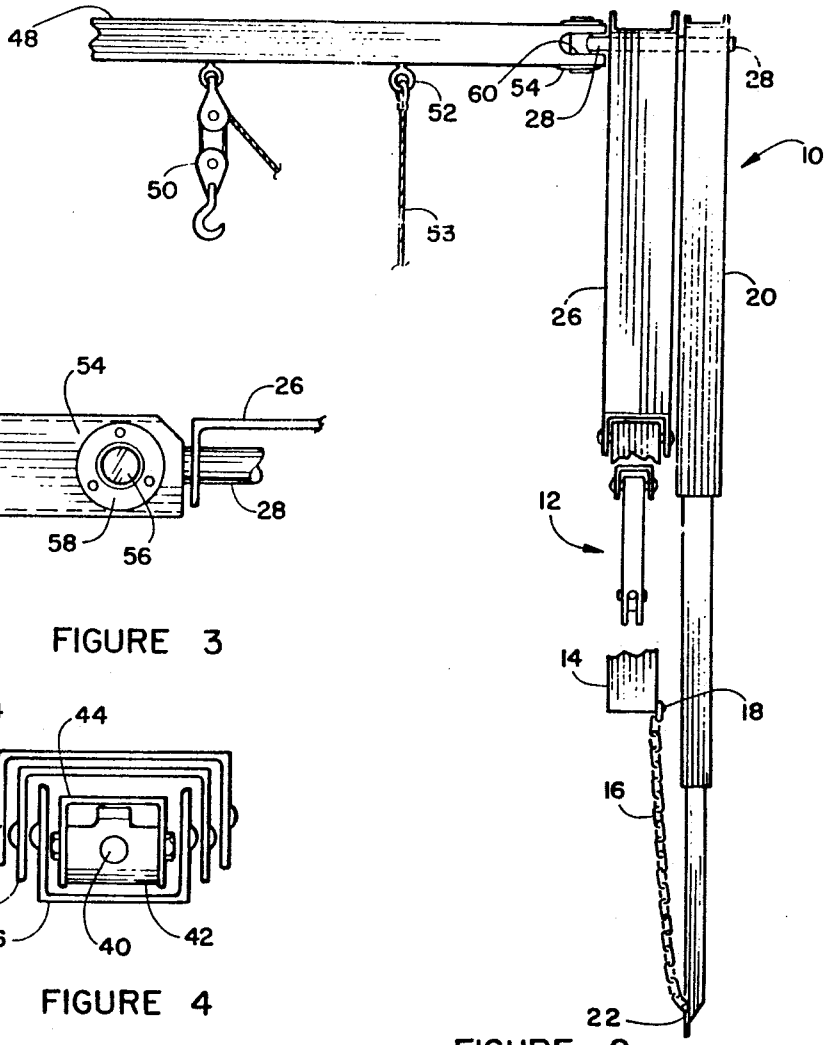
FIG. 2 is a schematic front elevation view of the hoisting apparatus.
Figure 1:
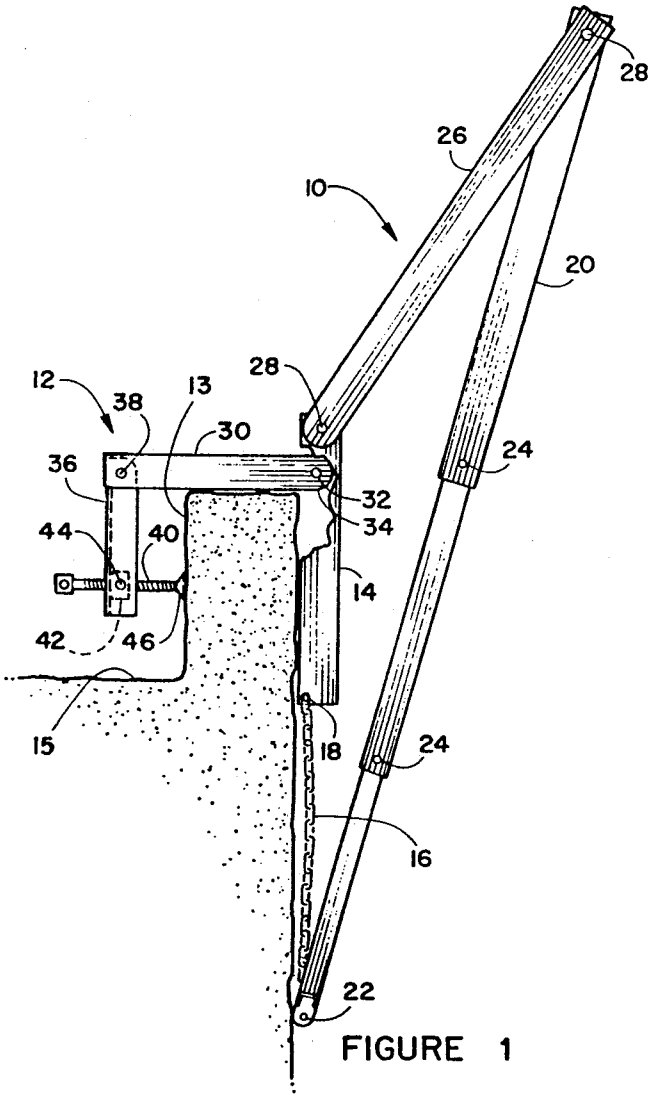
FIG. 1 is a schematic side elevation view of the hoisting apparatus in position for hoisting from a parapet.

Referring now to FIGS. 1 and 2 there is seen a hoisting apparatus including a pair of spaced triangular leg assemblies 10 (one shown) each with a clamping assembly 12. As shown, the hoisting apparatus is mounted on a parapet 13 along the edge of a roof 15.

Triangular assembly 10 includes a first leg made up of a beam 14 and flexible extension 16 secured together by a conventional clevis 18. Beam 14 has a channel cross section, open to the side contacting parapet 13, as detailed below. Flexible extension 16 is preferably formed from a length of high strength chain, although a steel cable or other flexible, high strength material could be used if desired.

A second leg 20 is connected to the free end of flexible extension 16 through a suitable fitting 22. Leg 20 is preferably made up of a plurality of telescoping square tube sections to permit the leg to be collapsed for transportation. In the extended position shown, the sections are held in place by pins or bolts 24.

A third leg 26, typically a channel section, is pivotally connected to the second ends of beam 14 and second leg 20 by pins 28.

Beam 14 further forms part of the clamp assembly 12. A second clamp member 30 is pivotally connected to beam 14 by pin 32. second member 30 has a channel section with a cam-like surface 34 which allows member 30 to be pivoted counter clockwise as seen in FIG. 1 to nest within beam 14 and to be pivoted clockwise into the position shown, with the very end of member 30 in contact with the inner surface of channel beam 14, preventing further rotation. A third clamp member 36 is similarly pivotally mounted at the opposite end of second member 30, for rotation about a pin 38 between a folded position and a position with the end of member 36 abutting the inner surface of member 30 to prevent further rotation, so that the fully opened clamp 12 has a "C" shape. A "T" handled clamping screw 40 extends through a threaded block 42, rotatable about a pin 44 extending through member 36. Screw 40 has a swivel foot 46 which presses against parapet 13.

A cross beam 48 extends between the intersections between second leg 20 and third leg 26, as best seen in FIG. 2, of each of the two triangular assemblies 10. A hoisting device, such as a conventional block-and-tackle assembly 50, is secured to cross beam 48 intermediate the ends thereof. An eye bolt 52 is also secured to cross beam 48 for connection of a rope 53 or the like for moving the hoisting apparatus between positions between positions extending beyond the roof surface, as shown in FIG. 1, and the delivery position extending inwardly of the parapet 13, as detailed below.

Figure 3:
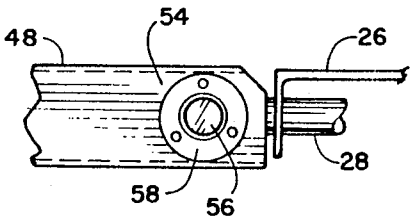
FIG. 3 is a detail section view taken on line 3—3 in FIG. 2.

Cross beam 48 is held to each of the triangular assemblies 10 by pins 28, each of which extends through the second ends of one pair of legs 20 and 26 and is secured to a rotatable bushing 54, as seen in FIGS. 2 and 3. Bushing 54 includes a central shaft 56 secured to pin 28 and rotatable in two cup-like end fittings 58 mounted on opposite walls of the beam box section by screws, welding or the like. Cross beam 48, which is typically a box section, has a slot 60 at each end so that the beam can be folded, with bushing 54 rotating and pin 28 moving along slot. Slots in the two ends of cross beam 28 may be in opposite sides so that the beam and triangular assemblies can be folded in a "zig zag" or "fan folded" manner.

In operation, the hoisting apparatus is unfolded, leg 20 is extended and the assembly is placed on a parapet 13. If desired, resilient material may be placed between beam 14, member 30 and swivel foot 46 and parapet 13 to protect the parapet surface. The hook on hoisting mechanism 50 is lowered, the object to be lifted is attached thereto and the object is lifted to a position above parapet 13. A rope 53 or the like attached to eyebolt 52 is then pulled to pull cross beam 48 toward and over to a position above roof 15 inside parapet 13. This pull causes rotation of leg 26 about lower pin 28, slackening flexible extension 16, moving triangular assembly in an "over center" manner to a position where legs 20 and 26 are parallel and adjacent, with the central area of leg 20 contacting and pivoting about the edge of parapet 13.

Figure 4:
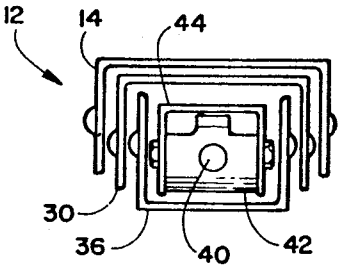
FIG. 4 is a detail section view of the clamp components, taken on line 4—4 in FIG. 2, but after the clamp has been folded.

When all hoisting has been accomplished, the assembly is unclamped by retracting screw 40 and lifting the assembly onto roof 15. Clamp assembly 12 is folded into the configuration shown in FIG. 4, with block 42 pivoted so that screw 40 lies within and parallel to member 36, member 36 folded and within member 30 and finally member 30 folded and within beam 14. Beam 48 is folded relative to triangular assemblies 10 in a fan folded manner so that the triangular assemblies and cross beam lie adjacent to each other. Leg 20 is telescoped together, so that flexible extension 16 extends up to the now shortened location of fitting 22. This compact package can then be easily carried down a ladder, stairway or the like by a single person.

The hoisting assembly of this invention is further adaptable to hoisting objects through a hatch or other opening. In that case, second leg 20 is left in the collapsed telescoped position, with end fitting 22 lying just below the lower end of the upper sleeve of leg 20 as seen in FIG. 1. Clamp assembly 20 is left in the folded position. Cross beam 48 and the two triangular assemblies are unfolded and one triangular assembly is placed on each side of the hatch. Beam 14 and flexible extension 16 are laid flat and horizontal on opposite sides of the hatch, with legs 26 and collapsed, now short, leg 20 forming a substantially equilateral triangle above the hatch, with the block-and-tackle 50 above the center of the hatch.

While the hoisting assembly may have any suitable dimensions, for hoisting CFC handling devices used in roof air conditioning repair, or other compact objects in the 75–150 pound weight range, cross beam 48 and leg 26 may have lengths in the 30 to 40 inch range, with other components in proportion. The various components may be made from any suitable materials, such as steel or high strength aluminum.

Other applications, variations and ramifications of this invention will occur to those skilled in the art upon reading this disclosure. Those are intended to be included within the scope of this invention, as defined in the appended claims.

I claim:

1. A hoisting apparatus for raising objects up the side of a structure and swinging the objects onto the structure roof which comprises:

a pair of substantially identical triangular assemblies each made up of three legs, said legs comprising;

a first leg having a beam that lies substantially vertically during hoist operation and a flexible extension connected to and extending away from a first end of said beam;

a second leg having a first end secured to the second end of said flexible extension;

a third leg pivotally secured between the second ends of said first and second legs;

said first and second legs forming an acute angle;

a cross beam extending between the intersection of said second and third legs of each of said triangular assemblies;

said cross beam adapted to support a hoisting means intermediate its ends;

clamp means incorporating said beams and adapted to secure said triangular assemblies to a structure roof edge with said triangular assembly extending upwardly and outwardly of the roof edge; and means for moving said cross beam toward and inwardly of said roof edge;

whereby said hoisting means may be operated to raise an object to a level above said roof edge and said cross beam may be pulled toward said roof edge so that said triangular assembly is moved over center, swinging said object onto the roof.

2. The hoisting apparatus according to claim 1 wherein said second leg is made up of at least three telescoping members and movable between an extended position and a collapsed position and further includes means for selectively locking said members in an extended position.

3. The hoisting apparatus according to claim 1 wherein said flexible extension extends between said beam and said first end of said second leg with said second leg in either the extended or collapsed position.

4. The hoisting apparatus according to claim 1 wherein said beam is a channel section and said clamp means comprises said beam and a first additional channel section pivotally secured within one end of said beam, a second additional channel section pivotally secured within said first additional, said three channel sections configured to be movable between a stowed position with said second additional channel section nested within said first additional channel section which is in turn nested within said beam and an operative position in which said sections are configured in a "C" shape, said clamp means further including a clamping screw mounted on said second additional channel section to be threadable toward said beam and clamp against an intervening structure.

5. The hoisting apparatus according to claim 1 wherein said beam is secured to each of said intersections of said second and third legs by a pin that extends through that intersection to pivotally secure said second and third legs together and further extends into the cross beam end where the pin is rigidly secured to a rotatable bushing mounted in said beam, said beam further including a slot configured to allow said pin to ride in said slot as said beam is folded about said bushing relative to said second and third arms from a operative position substantially perpendicular to said second and third arms to a stowed position substantially parallel to said first and second arms.

6. The hoisting apparatus according to claim 1 wherein said flexible extension is a length of chain.

7. The hoisting apparatus according to claim 1 wherein said means for moving said cross beam comprises a manually pullable means extending from said cross beam intermediate the ends thereof.

8. The method of hoisting objects up the side of a structure and onto the structure upper surface which comprises the steps of:

providing a pair of substantially identical triangular assemblies, each of which is made up of three legs, a first leg comprising a beam with a flexible extension at a first end, a second leg secured at a first end to the free end of said flexible extension and a third leg pivotally secured to the second ends of said beam and second leg, forming a triangle with said second and third ends forming an acute angle;

providing a cross beam between the intersections of said second and third legs of each triangular assembly with a hoisting means intermediate the cross beam ends;

securing said triangular assemblies to the edge of the structure upper surface with said triangular assemblies extending upwardly and outwardly of said edge and substantially parallel to each other;

operating said hoisting means to lift an object up along said structure side to a point above the structure upper surface;

moving said cross beam inwardly towards and past said upper surface edge by causing said triangular assemblies to pass over center; and lowering said object onto the upper surface.

9. The method according to claim 8 including the further steps of lowering said object back down the structure side by operating said hoisting means to lift said object off of the upper surface, pushing said beam back out over said edge by causing said triangular assemblies to move over center and operating said hoisting means to lower said object down along said side.

10. The method according to claim 8 wherein said triangular assemblies are secured to said structure by placing "C" shaped clamping means secured to said triangular assemblies over a parapet along said edge and operating a screw means for clamping said parapet between a portion of said clamping means and said screw.

* * * * *